US011685974B2

(12) United States Patent
Hwang et al.

(10) Patent No.: US 11,685,974 B2
(45) Date of Patent: Jun. 27, 2023

(54) ALUMINUM ALLOYS

(71) Applicant: Lemon Metal Inc., Seongnam-si (KR)

(72) Inventors: Se Joon Hwang, Seongnam-si (KR); Han Goo Kim, Seongnam-si (KR); Kwang Hoon Park, Incheon (KR)

(73) Assignee: Lemon Metal Inc., Seongnam-si (KR)

( * ) Notice: Subject to any disclaimer, the term of this patent is extended or adjusted under 35 U.S.C. 154(b) by 0 days.

(21) Appl. No.: 17/719,890

(22) Filed: Apr. 13, 2022

(65) Prior Publication Data

US 2022/0325386 A1 Oct. 13, 2022

(30) Foreign Application Priority Data

Apr. 13, 2021 (KR) ..... 10-2021-0047657
Mar. 22, 2022 (KR) ..... 10-2022-0035240

(51) Int. Cl.
*C22C 21/02* (2006.01)

(52) U.S. Cl.
CPC ..... *C22C 21/02* (2013.01)

(58) Field of Classification Search
CPC ..... C22C 21/02; C22F 1/043
See application file for complete search history.

(56) References Cited

U.S. PATENT DOCUMENTS 6,921,584 B2 * 7/2005 Syslak ..... C22C 21/02 165/905
2018/0057913 A1 * 3/2018 Hu ..... C22C 21/02

FOREIGN PATENT DOCUMENTS

KR 10-2011-0038357 A 4/2011
KR 10-2011-0065122 A 6/2011
KR 10-1468957 B1 12/2014
KR 10-1544888 B1 8/2015
KR 10-2016-0138866 A 12/2016

* cited by examiner

*Primary Examiner* — Jessee R Roe
(74) *Attorney, Agent, or Firm* — Paratus Law Group, PLLC

(57) ABSTRACT

An aluminum alloys, essentially includes silicon (Si), iron (Fe), and magnesium (Mg), and is characterized as being an aluminum alloys including at least one or two or more of copper (Cu), manganese (Mn), zinc (Zn), titanium (Ti), calcium (Ca), tin (Sn), phosphorus (P), chromium (Cr), zirconium (Zr), nickel (Ni), strontium (Sr), and vanadium (V).

6 Claims, 6 Drawing Sheets

| Classification | Temperature (°C) | Note |
|---|---|---|
| Example-148 | 57.01 | Up to 35% improvement |
| Example-150 | 57.35 | |
| Example-155 | 58.11 | |
| Example-162 | 59.24 | |
| Comparative Example | 43.52 | |

| Classification | Temperature (°C) 30 sec 구간 | Note |
|---|---|---|
| Example-148 | 35.33 | Up to 47% improvement |
| Example-150 | 35.22 | |
| Example-155 | 34.98 | |
| Example-162 | 34.63 | |
| Comparative Example | 51.09 | |

ALUMINUM ALLOYS

CROSS-REFERENCE TO RELATED APPLICATIONS

This application claims priority to and the benefit of Korean Patent Application No. 10-2021-0047657, filed on Apr. 13, 2021 and Korean Patent Application No. 10-2022-0035240, filed on Mar. 22, 2022, which are hereby incorporated by reference in their entirety.

BACKGROUND

The present disclosure relates to aluminum alloys, and more particularly, to aluminum alloys for casting or die casting used in mechanical parts or electrical and electronic products.

In general, aluminum is light and easy to cast, has a face centered cubic (FCC) crystal structure and has high solubility, so it is well alloyed with other metals, is easy to process at room temperature and high temperature, and has good electrical and thermal conductivity, so it's widely used in industry. In particular, in recent years, aluminum alloys in which aluminum is mixed with other metals are widely used to improve fuel efficiency or reduce the weight of automobiles and electronic products.

As a method of manufacturing a product from such an aluminum alloy, a die casting method is widely used. Die casting is a precision casting method that obtains the same casting as the mold by injecting molten metal into a mold that is precisely machined according to the required casting shape.

This die casting method has high mass productivity because the dimensions of the product to be produced are accurate, so there is little need for a post-process such as finishing, mass production is possible, and production costs are low. As a result, the die casting method is most often used in various fields such as automobile parts, electric devices, optical devices, and measuring instruments.

However, in the die casting method, gas is incorporated into the molten metal during the process, and the incorporated gas may be present as defects such as voids in the final product. Accordingly, the die casting method may have a disadvantage in that elongation is lowered.

Meanwhile, conventional aluminum alloys show a high degree of utilization, accounting for about 90% or more of the materials used in the die casting process. However, conventional aluminum alloys such as A383 are falling behind the market demand for heat dissipation efficiency due to the recent miniaturization and integration of electronic components.

SUMMARY

The present disclosure has been devised to solve the problems of the related art as described above.

Specifically, the present disclosure is to provide new aluminum alloys having superior electrical conductivity, thermal conductivity, and formability compared to conventional aluminum alloys by controlling the composition ratio of silicon, iron, and magnesium in an aluminum base.

Through this, an object of the present disclosure is to provide a new aluminum alloys those can be used for various parts requiring heat dissipation properties.

In addition, another object of the present disclosure is to provide aluminum alloys capable of further improving thermal conduction and heat dissipation properties and further improving castability at the same time compared to conventional aluminum alloys by more precisely limiting the composition ratio of iron and magnesium and further including copper and manganese.

An aluminum alloy according to an embodiment of the present disclosure for achieving the above objects is characterized in that it includes 8.0 to 9.0 wt % of silicon (Si); 0.35 to 0.55 wt % of iron (Fe); and 0.02 to 0.3 wt % of magnesium (Mg), based on the total amount of the alloy.

An aluminum alloy according to another embodiment of the present disclosure for achieving the above objects is characterized in that it includes 8.0 to 9.0 wt % of silicon (Si); 0.35 to 0.55 wt % of iron (Fe); 0.02 to 0.3 wt % of magnesium (Mg), and includes at least one or two or more of 0.001 to 0.2 wt % of copper (Cu); 0.001 to 0.2 wt % of manganese (Mn); 0.001 to 0.2 wt % of zinc (Zn); 0.001 to 0.2 wt % of titanium (Ti); 0.001 to 0.2 wt % of calcium (Ca); 0.001 to 0.2 wt % of tin (Sn); 0.001 to 0.2 wt % of phosphorus (P); 0.001 to 0.2 wt % of chromium (Cr); 0.001 to 0.2 wt % of zirconium (Zr); 0.001 to 0.2 wt % of nickel (Ni); 0.001 to 0.1 wt % of strontium (Sr); 0.001 to 0.01 wt % of vanadium (V), based on the total amount of the alloy.

The aluminum alloys according to the present disclosure are characterized in that they has an electrical conductivity of 30 to 40% IACS and a thermal conductivity of 145 to 165 W/mK at a temperature of 25 to 200° C.

The new aluminum alloys of the present disclosure provide an effect which can be used for various parts requiring heat dissipation properties by controlling the composition ratio of silicon, iron, and magnesium in the aluminum base to secure superior electrical and thermal conductivity and formability compared to conventional aluminum alloys.

BRIEF DESCRIPTION OF THE DRAWINGS

The above and other objects, features and advantages of the present disclosure will become more apparent to those of ordinary skill in the art by describing exemplary implementations thereof in detail with reference to the accompanying drawings, in which.

DETAILED DESCRIPTION

Figure 1:
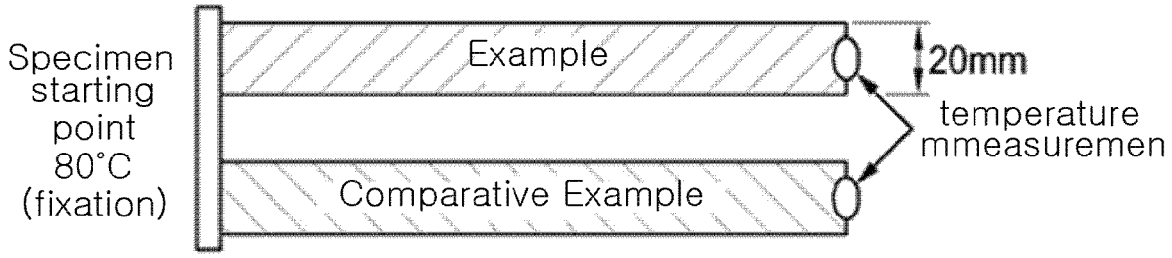
FIG. 1 is a configuration diagram showing a measurement state of the thermal conduction performance of an aluminum alloy according to an embodiment of the present disclosure.

Hereinafter, preferred embodiments of the present disclosure will be described in detail with reference to the accompanying drawings.

The aluminum alloys according to the embodiment of the present disclosure are an aluminum alloys for casting or die casting used for mechanical parts, electrical and electronic products. For this purpose, the aluminum alloys according to the embodiment of the present disclosure includes aluminum (Al) as a base, essentially includes as much silicon (Si), iron (Fe), and magnesium (Mg) as a controlled composition range, and furthermore, is an aluminum alloy consisting of at least one or two or more of copper (Cu), manganese (Mn), zinc (Zn), titanium (Ti), calcium (Ca), tin (Sn), phosphorus (P), chromium (Cr), zirconium (Zr), nickel (Ni), strontium (Sr), and vanadium (V) and some impurities.

Silicon (Si) is added to improve the fluidity and strength of the aluminum alloys of the present disclosure.

In addition, when silicon (Si) is added to the aluminum alloys of the present disclosure, the liquidus temperature of the aluminum alloys is reduced according to the addition of silicon (Si). As a result, as the solidification time of the aluminum alloys becomes longer, the castability of the aluminum alloys is improved.

In addition, the low solubility of silicon (Si) in the aluminum (Al) base causes the precipitation of pure silicon (pure Si). The precipitated silicon (Si) can improve friction resistance, and improve the fluidity, castability, thermal conductivity, and tensile strength of the aluminum alloy.

The composition range of silicon (Si) added to the aluminum alloys of the present disclosure is preferably 8.0 to 9.0 wt % (or %).

When the composition range of silicon (Si) is less than 8.0 wt %, there is a problem in that it is difficult to realize the effect of improving fluidity and strength.

On the other hand, when the composition range of silicon (Si) is more than 9.0 wt %, since an Si intermetallic compound is formed according to a reaction with other additive elements to be described below along with needle-shaped or plate-shaped Si precipitation due to excessive silicon (Si) in the aluminum alloys of the present disclosure, there is a problem in that the elongation of the alloys is lowered and thermal conductivity is excessively reduced.

Since iron (Fe) is mostly precipitated into an intermetallic compound such as $Al_3Fe$ after casting in the aluminum alloys of the present disclosure (primary precipitation), the decrease in thermal conductivity of aluminum is minimized and it is possible to increase the strength of the alloy due to the higher density of iron (Fe)compared to aluminum. At the same time, iron (Fe) can reduce mold sticking when forming an aluminum alloy product by die casting.

The composition range of iron (Fe) added to the aluminum alloys of the present disclosure is preferably 0.35 to 0.55 wt % (or %).

When the composition range of iron (Fe) is less than 0.35 wt % or more than 0.55 wt %, the thermal conductivity of the aluminum alloys of the present disclosure may be lowered, pores may be generated in the casting, or strength improvement may be insufficient.

Furthermore, iron (Fe) can prevent the adhesion of the aluminum alloys of the present disclosure and improve strength.

For this purpose, the composition range of iron (Fe) added to the aluminum alloys of the present disclosure is more preferably 0.40 to 0.50 wt % (or %).

When the composition range of iron (Fe) is less than 0.4 wt %, there is a problem in that it is difficult to realize the effect of preventing the adhesion and improving strength.

On the other hand, when the composition range of iron (Fe) is more than 0.5 wt %, the corrosion resistance of the aluminum alloys is lowered due to the presence of excessive iron (Fe), and there is a problem in that precipitates are easy to occur in the aluminum alloys.

In addition, iron (Fe) is effective in suppressing the coarsening of the recrystallized grains in the aluminum alloys and refining the grains during casting. However, when iron (Fe) is included in the aluminum alloys in an amount of 0.7 wt % or more, corrosion of the aluminum alloys may be caused.

Magnesium (Mg) improves the castability of the aluminum alloys, improves the mechanical properties of the alloys by solid solution hardening and a precipitation strengthening mechanism, and further significantly affects the thermal conductivity of the alloys.

Specifically, magnesium (Mg) is combined with the silicon (Si) in the aluminum alloys and precipitated as silicide in the form of $Mg_2Si$ to affect the mechanical properties, and the remaining silicon combined with magnesium is precipitated alone in the form of silicon to improve mechanical properties and strength.

In addition, magnesium (Mg) serves to prevent internal corrosion of the alloys due to a passivation effect by rapidly growing a dense surface oxide layer (MgO) on the surface of the aluminum alloys.

Furthermore, magnesium (Mg) has the effect of improving the machinability along with the weight reduction of the aluminum alloys.

Magnesium (Mg) is preferably included in an amount of 0.02 to 0.3 wt % based on the total weight of the aluminum alloys of the present disclosure.

When the composition range of magnesium (Mg) is less than 0.02 wt %, there is a problem in that it is difficult to realize the effects of adding magnesium.

On the other hand, when the composition range of magnesium (Mg) is more than 0.3 wt %, there is a problem in that the thermal conductivity is rather reduced, and the fluidity of the alloys is lowered, making it difficult to manufacture a product having a complex shape.

The aluminum alloys of the present disclosure may include at least one or two or more of the following alloy elements (including unavoidable impurities).

Copper (Cu), as a component included in a content of 0.001 to 0.2 wt % based on the total weight of the aluminum alloys of the present disclosure, affects the hardness, strength, and corrosion resistance of the aluminum alloys. Therefore, when the composition range of copper (Cu) is 0.001 to 0.2 wt %, it is possible to improve the strength without reducing the corrosion resistance of the aluminum alloys within the above range.

Copper (Cu) improves the strength of the aluminum alloys by a solid solution hardening mechanism. Copper (Cu) is preferably included within the range of 0.001 to 0.2 wt % based on the total weight of the aluminum alloys. When copper is added in an amount of less than 0.001 wt %, the effect of improving the strength is lowered. On the other hand, when copper is more than 0.2 wt %, the corrosion resistance of the aluminum alloys is lowered.

In addition, copper (Cu) may improve the fluidity of the molten metal. However, when an excessive amount of copper is added to the aluminum alloys, the corrosion resistance of the aluminum alloys may be lowered and weldability may be lowered. Also, similar to the iron (Fe) described above, when copper is included in the aluminum alloys in an amount of more than 0.2 wt %, copper may cause corrosion of the aluminum alloys.

Manganese (Mn) improves the corrosion resistance of the aluminum alloys, improves the tensile strength of the alloy through the solid solution hardening effect and a fine precipitate dispersion effect, and further may increase the softening resistance at high temperature and improve surface treatment properties.

Manganese (Mn) is preferably included within the range of 0.001 to 0.2 wt % based on the total weight of the aluminum alloys.

When the composition range of manganese (Mn) is less than 0.001 wt %, the effect of adding manganese cannot be achieved.

On the other hand, when the composition range of manganese (Mn) is more than 0.2 wt %, there is a problem in that castability is lowered.

Zinc (Zn) can improve the castability and electrochemical properties of aluminum alloys, and can improve mechanical properties by solid solution hardening and precipitation strengthening effects.

Zinc (Zn) is preferably included within the range of 0.001 to 0.2 wt % based on the total weight of the aluminum alloys.

When the composition range of zinc (Zn) is less than 0.001 wt %, the effect of adding zinc cannot be achieved.

On the other hand, when the composition range of zinc (Zn) is more than 0.2 wt %, there is a problem in that castability, weldability, and corrosion resistance are lowered.

Titanium (Ti) enables crystal grain refinement of the aluminum alloys by precipitating intermetallic compounds such as $Al_3Ti$ in the liquid phase (primary precipitation) during casting of the aluminum alloys without lowering the castability of the aluminum alloys, and can prevent cracks in the cast material. In addition, titanium can improve the mechanical properties and corrosion resistance of the aluminum alloys by increasing the precipitation of the intermetallic compound in the aluminum base by precipitation hardening heat treatment.

Titanium (Ti) is preferably included within the range of 0.001 to 0.2 wt % based on the total weight of the aluminum alloys.

When the composition range of titanium (Ti) is less than 0.001 wt %, the effect of adding titanium cannot be achieved.

On the other hand, when the composition range of titanium (Ti) is more than 0.2 wt %, since the intermetallic compound is generated in a large amount, there is a problem in that the mechanical properties of the alloys are lowered, and there is a problem in that the castability, weldability and corrosion resistance of the alloys are lowered.

Calcium (Ca) improves the hardness, tensile strength, and elongation of the alloys by spherodizing the plate-shaped silicon (Si) in the aluminum alloys.

Calcium (Ca) is preferably included within the range of 0.001 to 0.2 wt % based on the total weight of the aluminum alloys.

Tin (Sn) improves the mechanical properties of the casting without reducing the thermal conductivity of the alloy in the aluminum alloys and improves the lubrication of mechanical parts that involve friction, such as bearings and bushings.

Tin (Sn) is preferably included within the range of 0.001 to 0.2 wt % based on the total weight of the aluminum alloys.

Unlike other alloy elements mentioned above, phosphorus (P) is an impurity that is easily incorporated during the refining and casting of aluminum. Therefore, when the content of phosphorus in the aluminum alloys increases, since the mechanical properties are lowered, the lower the content, the more advantageous. In addition, when a large amount of phosphorus (P) is included in the aluminum alloys, there is a problem in that the refinement of eutectic silicon (Si) in the molten metal cannot work effectively.

When the incorporation of phosphorus in the process of refining and casting aluminum is unavoidable, phosphorus (P) is preferably included in an amount of less than 0.2 wt %.

Chromium (Cr) contributes to improving corrosion resistance by increasing the density of the magnesium oxide layer (MgO) film in the aluminum alloys, and can improve the strength and elongation, wear resistance and heat resistance of the alloys through crystalline particle refinement.

Chromium (Cr) is preferably included within the range of 0.001 to 0.2 wt % based on the total weight of the aluminum alloys.

When the composition range of chromium (Cr) is less than 0.001 wt %, the effect of adding chromium cannot be achieved.

On the other hand, when the composition range of chromium (Cr) is more than 0.2 wt %, there is a problem in that the strength is rather lowered.

Zirconium (Zr) is an element that improves the strength of the alloys by creating a reinforced phase of $Al_3Zr$ in the aluminum alloy. On the other hand, zirconium has a higher melting point than aluminum, so there is a downside to mass production in melting through conventional high-pressure die casting.

Accordingly, it is preferable that zirconium (Zr) is preferably included within the range of 0.001 to 0.2 wt % based on the total weight of the aluminum alloys.

Nickel (Ni) may improve the hot hardness of the aluminum alloys and the corrosion resistance of the alloys. On the other hand, nickel (Ni) may contribute to the improvement of the heat resistance of the aluminum alloys, but the effect is insignificant, and on the contrary, as an impurity that can be added to aluminum, when it is contained at more than 0.2 wt %, it may cause corrosion of the material.

Strontium (Sr) may improve strength and elongation by refining and spheroidizing eutectic Si in an aluminum alloy. On the other hand, when strontium is excessively added, brittleness increases and strength properties may be lowered, and furthermore, gas incorporation and compound formation may be promoted.

Accordingly, it is preferable that strontium (Sr) is preferably included within the range of 0.001 to 0.1 wt % based on the total weight of the aluminum alloys.

Vanadium (V), as a component included in a content of 0.001 to 0.01 wt %, plays an important role in allowing the aluminum alloys to be processed into a product by high-pressure die casting.

In addition, the aluminum alloys of the present disclosure have an electrical conductivity of 30 to 40% IACS and a thermal conductivity of 145 W/mK or more at a temperature of 25° C. or more. Therefore, they can be widely applied to electronic device parts, electric device parts, and automobile parts that require excellent heat dissipation properties. In particular, it is more preferable that the aluminum alloys of the present disclosure have a thermal conductivity of 145 to 165 W/mK at a temperature of 25 to 200° C.

Hereinafter, with reference to FIGS. 1 to 7, the thermal conduction performance and heat dissipation performance between aluminum alloys of Examples and conventional aluminum alloys of Comparative Examples will be compared and described in detail.

Table 1 shows the results of measuring thermal conductivity, specific heat, and density between four aluminum alloys corresponding to Examples of the present disclosure and one aluminum alloy (Alloy A383 alloy) of a conventional Comparative Example.

As shown in Table 1, it can be seen that the aluminum alloys corresponding to the Examples of the present disclosure and the aluminum alloy of the Comparative Example exhibit different properties.

TABLE 1

| Classification | Thermal Conductivity (W/mK) | Specific Heat (J/(gK)) | Density (g/cm$^3$) |
|---|---|---|---|
| Example 148 | 148.829 | 0.875 | 2.678 |
| Example 150 | 150.874 | 0.875 | 2.678 |
| Example 155 | 155.465 | 0.875 | 2.678 |
| Example 162 | 162.603 | 0.875 | 2.678 |
| Comparative Example | 96.1 | 0.963 | 2.690 |

Figure 2:
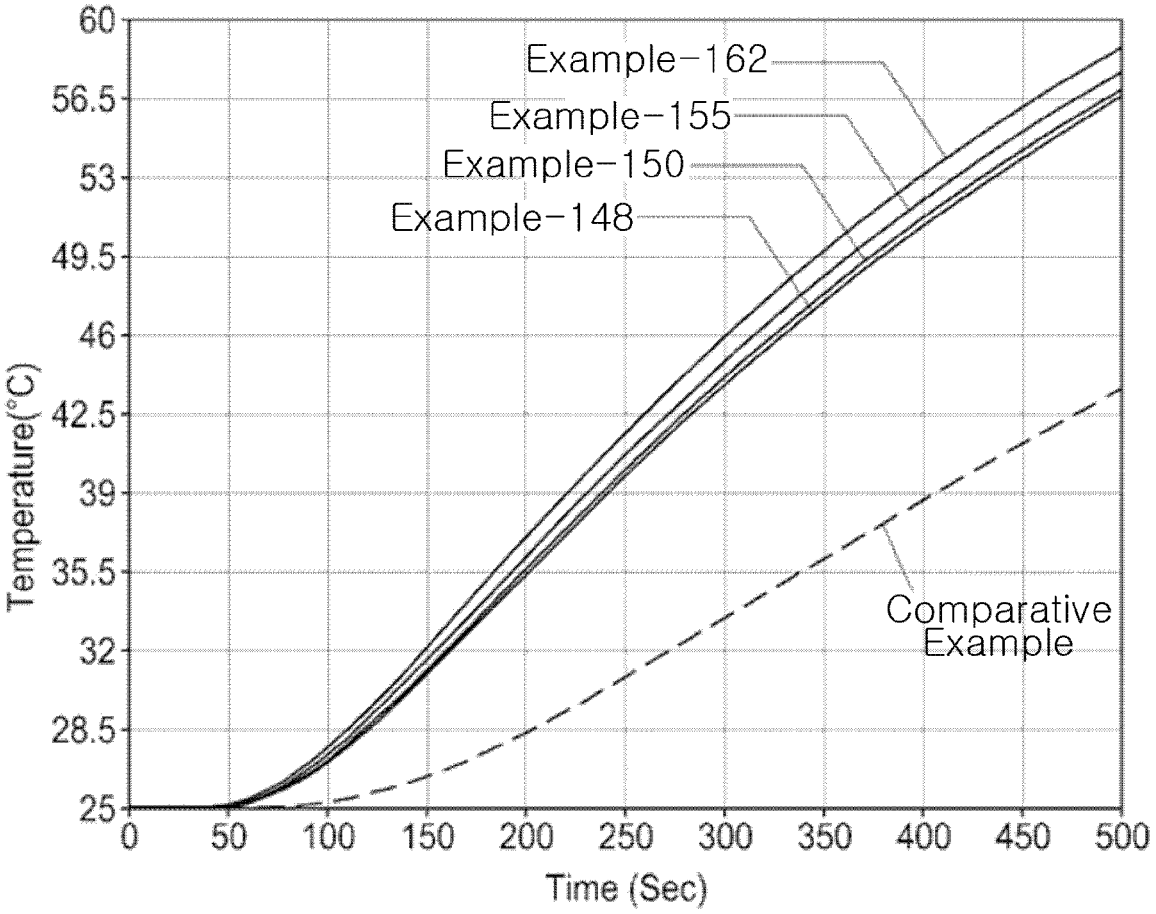
FIG. 2 is a graph showing the thermal conduction performance of an aluminum alloy according to an embodiment of the present disclosure.

FIG. 1 is a diagram schematically illustrating a method for measuring thermal conductivity of Table 1 and FIG. 2 to be described later.

As shown in FIG. 1, this thermal conductivity characteristic is the result of a measuring, over time, the temperature of the end point located opposite to the fixed end of a specimen of a predetermined size, maintained in a thermally insulated state from the outside for approximately 500 seconds, which is the test time, and maintained at 80° C. As a result of the thermal conductivity measurement, it was found that the aluminum alloy specimens of the Examples of the present disclosure had improved thermal conductivity by about 36% compared to the specimen of the Comparative Example.

Figure 3:
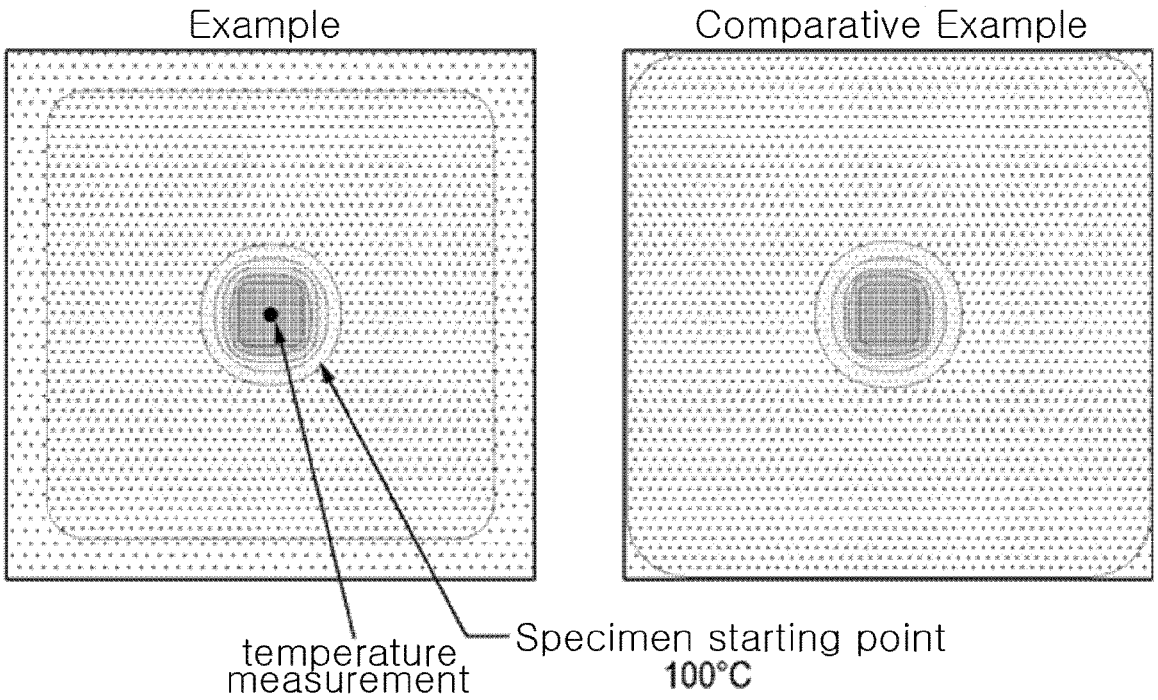
FIG. 3 is a configuration diagram showing a measurement state of the heat dissipation performance of an aluminum alloy according to an embodiment of the present disclosure.

The heat dissipation properties of aluminum alloys in the present disclosure were measured according to the method shown in FIG. 3. Specifically, the evaluation of the heat dissipation properties was determined by maintaining the fixed end of the specimen of a predetermined size at 100° C., maintaining the external temperature at an air-cooled room temperature of 25° C. and measuring the temperature over time of the measurement point for 15 seconds.

Figure 4:
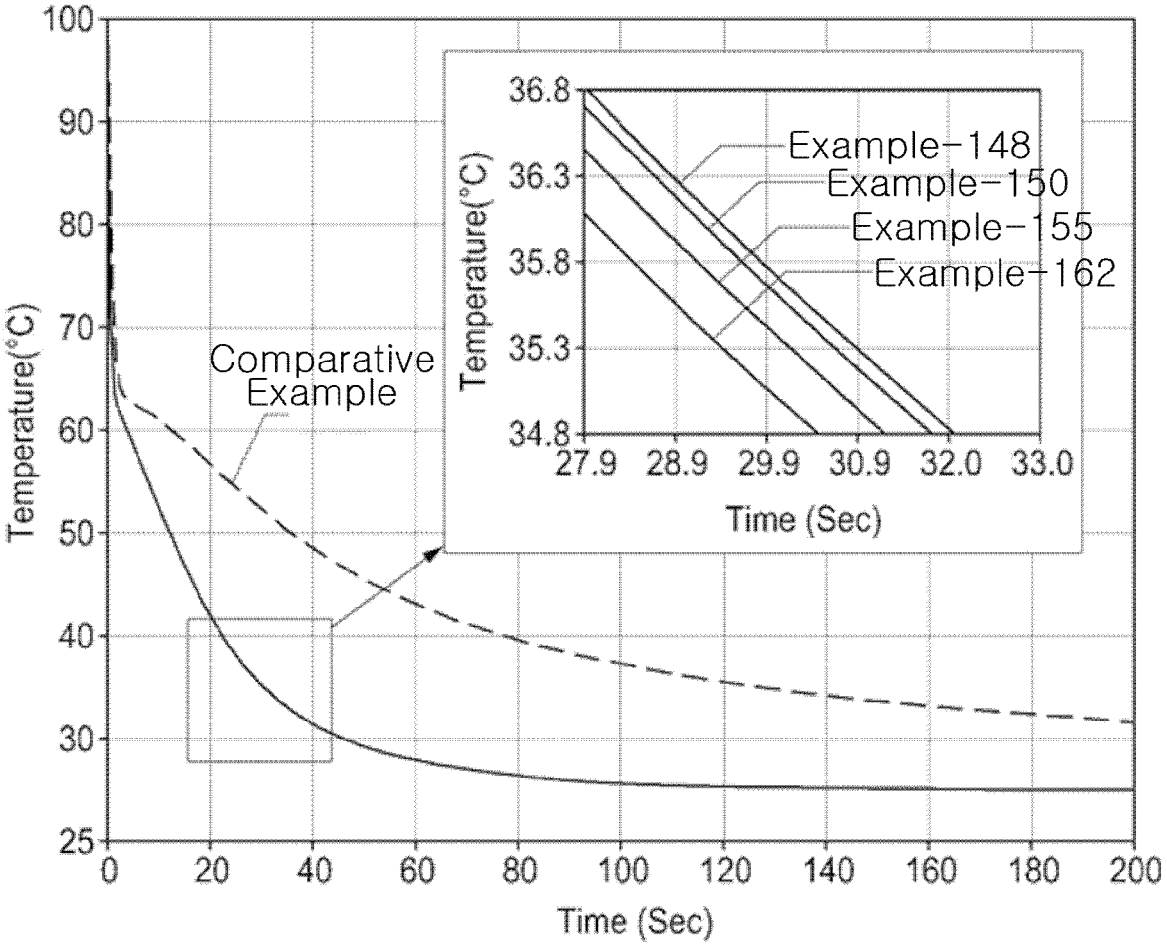
FIG. 4 is a graph showing the heat dissipation performance of an aluminum alloy according to an embodiment of the present disclosure.

As a result of measuring the heat dissipation properties, it was found that the heat dissipation property of the aluminum alloy specimens of the Examples of the present disclosure had improved by about 47% compared to the aluminum alloy specimen of the Comparative Example (FIG. 4).

Tables 2 to 4 below and FIGS. 5 to 7 quantitatively show the effect of the addition of alloy elements on the thermal conductivity properties of the aluminum alloys of the present disclosure.

The thermal conductivity of Tables 2 to 4 and FIGS. 5 to 7 below was measured according to ASTM E146 (Standard Test Method for Thermal Diffusivity by the Flash Method).

Specifically, first, when the thermal diffusivity ($\alpha$) is measured, and the density ($\rho$) and specific heat ($c_p$) of the specimen are measured, the thermal conductivity ($\lambda$) is calculated by the following equation.

$$\lambda=\alpha*\rho*c_p$$

Table 2 below is a result of measuring the thermal conductivity according to the composition range of Mg in the aluminum alloys according to an example of the present disclosure in a state in which the composition ranges of Si and Fe are substantially fixed.

TABLE 2

| Classification | Main Component(%) Si | Fe | Mg | Thermal Conductivity (W/mK) |
|---|---|---|---|---|
| Example 1-1 | 8.61 | 0.49 | 0.05 | 147 |
| Example 1-2 | 8.60 | 0.50 | 0.12 | 155 |
| Example 1-3 | 8.60 | 0.51 | 0.20 | 160 |
| Example 1-4 | 8.61 | 0.49 | 0.25 | 151 |
| Comparative Example 1-1 | 8.62 | 0.50 | 0.32 | 125 |
| Comparative Example 1-2 | 8.60 | 0.50 | 0.41 | 119 |
| Comparative Example 1-3 | 8.60 | 0.49 | 0.52 | 111 |

Figure 5:
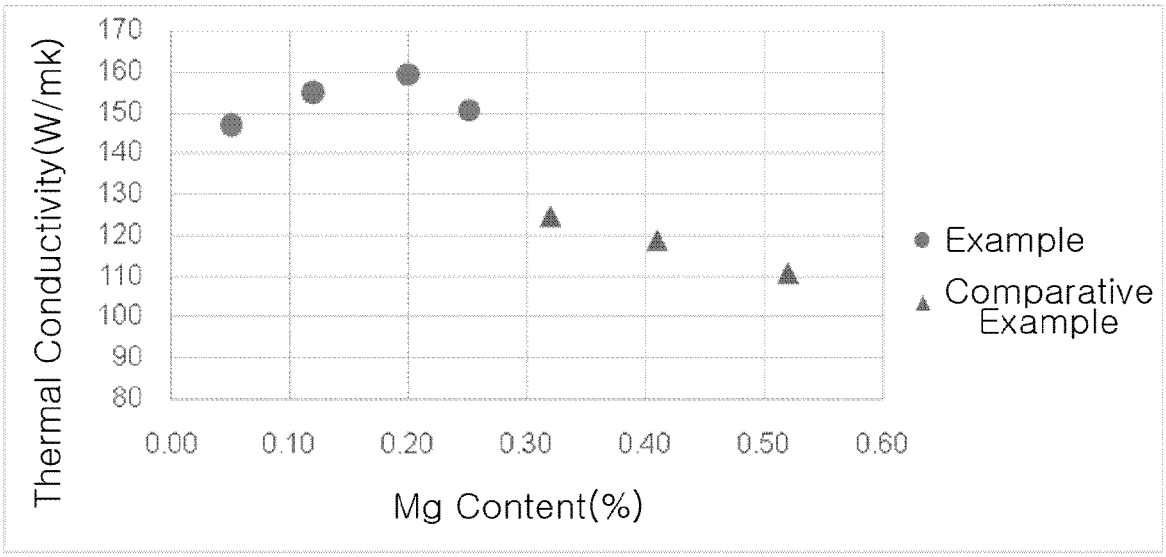
FIG. 5 is a graph showing the results of measuring the thermal conductivity of the aluminum alloys according to the Example of the present disclosure and the aluminum alloys of the Comparative Example according to Table 2.

FIG. 5 shows the results of measuring the thermal conductivity of the aluminum alloys according to the Example of the present disclosure and the aluminum alloys of the Comparative Example according to Table 2 above.

As the results of Table 2 and FIG. 5 show, the thermal conductivity of the example in which the composition range of Mg is 0.02 to 0.25 wt % is much higher than the thermal conductivity of the Comparative Example in which the composition range of Mg is 0.3 wt % or more.

Table 3 below is a result of measuring the thermal conductivity according to the composition range of Fe in the aluminum alloys according to an example of the present disclosure in a state in which the composition ranges of Si and Mg are substantially fixed.

TABLE 3

| Classification | Main Component(%) Si | Fe | Mg | Thermal Conductivity (W/mK) |
|---|---|---|---|---|
| Example 2-1 | 8.60 | 0.40 | 0.03 | 154 |
| Example 2-2 | 8.61 | 0.44 | 0.03 | 155 |
| Example 2-3 | 8.60 | 0.48 | 0.04 | 155 |
| Example 2-4 | 8.60 | 0.52 | 0.03 | 156 |
| Comparative Example 2-1 | 8.60 | 0.30 | 0.04 | 145 |
| Comparative Example 2-2 | 8.60 | 0.70 | 0.04 | 147 |
| Comparative Example 2-3 | 8.60 | 0.76 | 0.05 | 145 |
| Comparative Example 2-4 | 8.59 | 0.81 | 0.03 | 141 |

Figure 6:
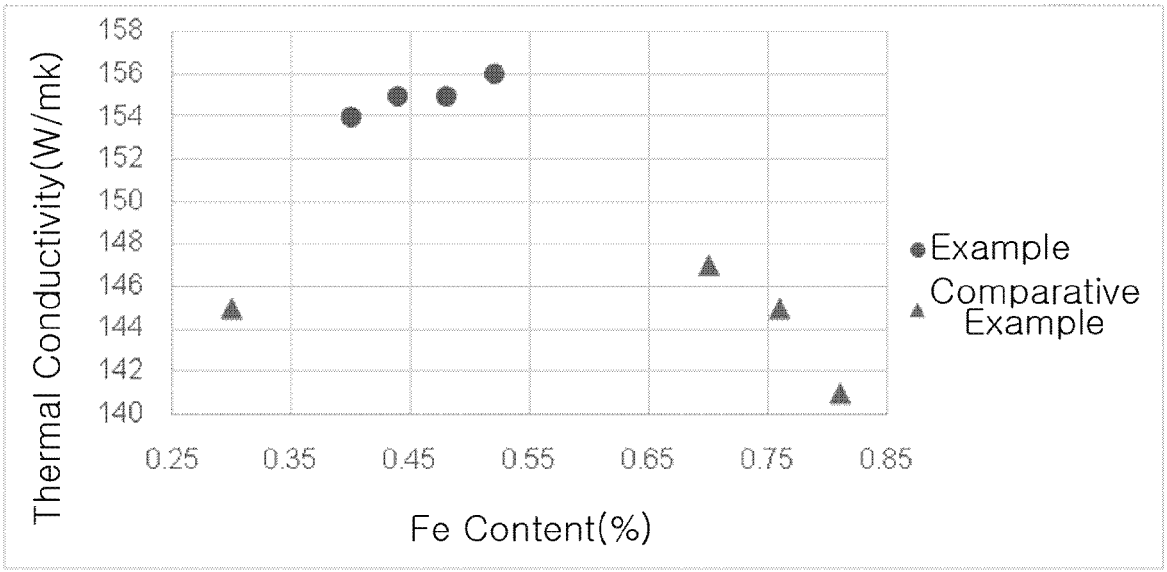
FIG. 6 is a graph showing the results of measuring the thermal conductivity of the aluminum alloys according to the Example of the present disclosure and the aluminum alloys of the Comparative Example according to Table 3.

FIG. 6 shows the results of measuring the thermal conductivity of the aluminum alloys according to the Example of the present disclosure and the aluminum alloys of the Comparative Example according to Table 3 above.

As the results of Table 3 and FIG. 6 show, the thermal conductivity of the example in which the composition range of Fe is 0.35 to 0.55 wt % is higher than the thermal conductivity of the Comparative Example in which the composition range of Fe is less than 0.35 wt % or more than 0.55 wt %.

Table 4 below is a result of measuring the thermal conductivity according to the composition range of Si in the aluminum alloys according to an example of the present disclosure in a state in which the composition ranges of Fe and Mg are substantially fixed.

TABLE 4

| Classification | Main Component(%) | | | Thermal Conductivity |
|---|---|---|---|---|
| | Si | Fe | Mg | (W/mK) |
| Example 3-1 | 8.20 | 0.36 | 0.28 | 164 |
| Example 3-2 | 8.40 | 0.35 | 0.29 | 162 |
| Example 3-3 | 8.60 | 0.35 | 0.28 | 160 |
| Example 3-4 | 8.80 | 0.35 | 0.28 | 158 |
| Comparative Example 3-1 | 9.50 | 0.36 | 0.29 | 142 |
| Comparative Example 3-2 | 12.50 | 0.35 | 0.30 | 127 |

Figure 7:
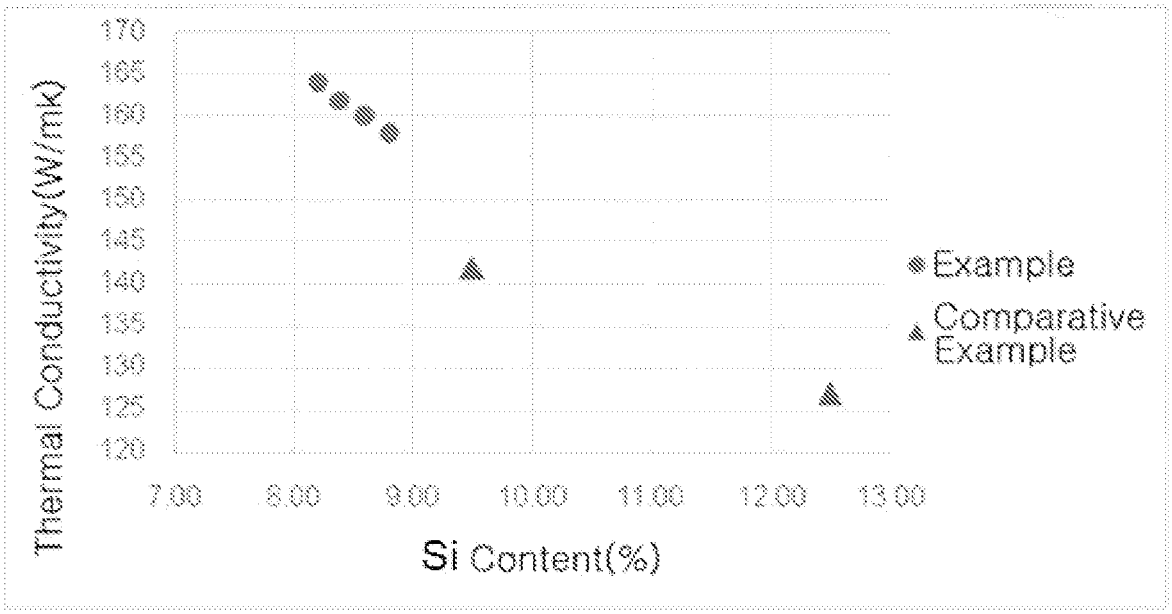
FIG. 7 is a graph showing the results of measuring the thermal conductivity of the aluminum alloys according to the Example of the present disclosure and the aluminum alloys of the Comparative Example according to Table 4.

FIG. 7 shows the results of measuring the thermal conductivity of the aluminum alloys according to the Example of the present disclosure and the aluminum alloys of the Comparative Example according to Table 4 above.

As the results of Table 4 and FIG. 7 show, the thermal conductivity of the example in which the composition range of Si is 8.0 to 9.0 wt % is higher than the thermal conductivity of the Comparative Example in which the composition range of Si is more than 9 wt %.

As described above, the aluminum alloys according to the present disclosure can secure superior electrical conductivity, formability and thermal conductivity compared to conventional commercial alloys by controlling the composition ratio of silicon, iron, and magnesium. Through this, the aluminum alloys according to the present disclosure provide an effect that can be used for various parts requiring heat dissipation properties.

In addition, the aluminum alloys of the present disclosure have a controled the composition ratio of silicon, iron and magnesium and further include copper and manganese, thereby providing an effect of further improving the thermal conduction and heat dissipation properties and further improving the castability at the same time compared to the conventional aluminum alloys.

In addition, the aluminum alloys of the present disclosure further include zinc, titanium, calcium, tin, phosphorus, chromium, zirconium, nickel, strontium and vanadium, thereby providing an effect of improving castability and electrochemical properties, improving the lubrication and mechanical properties of mechanical parts, improving heat resistance and corrosion resistance, and improving the hot hardness and tensile strength of the alloy.

The present disclosure described above can be embodied in various other forms without departing from the technical spirit or main features thereof. Accordingly, the above embodiments are merely exemplary in all respects and should not be construed as limiting.

What is claimed is:

1. An aluminum alloy, comprising, based on a total amount of the alloy:

8.0 to 9.0 wt % of silicon (Si);

0.35 to 0.55 wt % of iron (Fe); and 0.02 to 0.3 wt % of magnesium (Mg), wherein the silicon (Si) is combined with the magnesium (Mg) and precipitated as magnesium silicide ($Mg_2Si$), and wherein a remaining amount of the 8.0 to 9.0 wt % of the silicon (Si) is precipitated alone.

2. The aluminum alloy of claim 1, wherein the alloy has an electrical conductivity of 30 to 40% IACS and a thermal conductivity of 145 to 165 W/mK at a temperature of 25 to 200° C.

3. The aluminum alloy of claim 1, wherein the iron (Fe) is precipitated as iron aluminide ($Al_3Fe$).

4. The aluminum alloy of claim 1, further comprising at least one or two or more of:

0.001 to 0.2 wt % of copper (Cu);

0.001 to 0.2 wt % of manganese (Mn);

0.001 to 0.2 wt % of zinc (Zn);

0.001 to 0.2 wt % of titanium (Ti);

0.001 to 0.2 wt % of calcium (Ca);

0.001 to 0.2 wt % of tin (Sn);

0.001 to 0.2 wt % of phosphorus (P);

0.001 to 0.2 wt % of chromium (Cr);

0.001 to 0.2 wt % of zirconium (Zr);

0.001 to 0.2 wt % of nickel (Ni);

0.001 to 0.1 wt % of strontium (Sr); and 0.001 to 0.01 wt % of vanadium (V).

5. The aluminum alloy of claim 4, wherein the alloy has an electrical conductivity of 30 to 40% IACS and a thermal conductivity of 145 to 165 W/mK at a temperature of 25 to 200° C.

6. The aluminum alloy of claim 4, wherein the iron (Fe) is precipitated as iron aluminide ($Al_3Fe$).

* * * * *